US005594997A

United States Patent [19]

Lehtinen

[11] Patent Number: 5,594,997

[45] Date of Patent: Jan. 21, 1997

[54] APPARATUS FOR DRYING A FIBRE WEB, AND A DRYING SECTION OF A PAPER MACHINE

[75] Inventor: Jukka Lehtinen, Tampere, Finland

[73] Assignee: Valmet Corporation, Helsinki, Finland

[21] Appl. No.: 588,834

[22] Filed: Jan. 19, 1996

[30] Foreign Application Priority Data

Feb. 14, 1995 [FI] Finland ..... 950652

[51] Int. Cl.[6] ..... F26B 13/26

[52] U.S. Cl. ..... 34/95; 34/71; 34/355

[58] Field of Search ..... 34/66, 71, 95, 34/114, 116, 117, 388, 355

[56] References Cited

FOREIGN PATENT DOCUMENTS 326348 11/1991 European Pat. Off. .

*Primary Examiner*—Henry Bennett
*Assistant Examiner*—Dinnatia Doster
*Attorney, Agent, or Firm*—Ladas & Parry

[57] ABSTRACT

A drying apparatus for drying a fibre web between two tight bands that move in parallel and turn around turning rolls, wherein a fibre web is taken between heating wires through a drying zone defined by the bands, and auxiliary wires are arranged between the heating wires and the bands. The heating wires are permeable to steam, whereby the steam evaporating from the fibre web passes through the heating wires and the auxiliary wires toward the cooled bands simultaneously from both sides.

6 Claims, 2 Drawing Sheets

Figure 2:
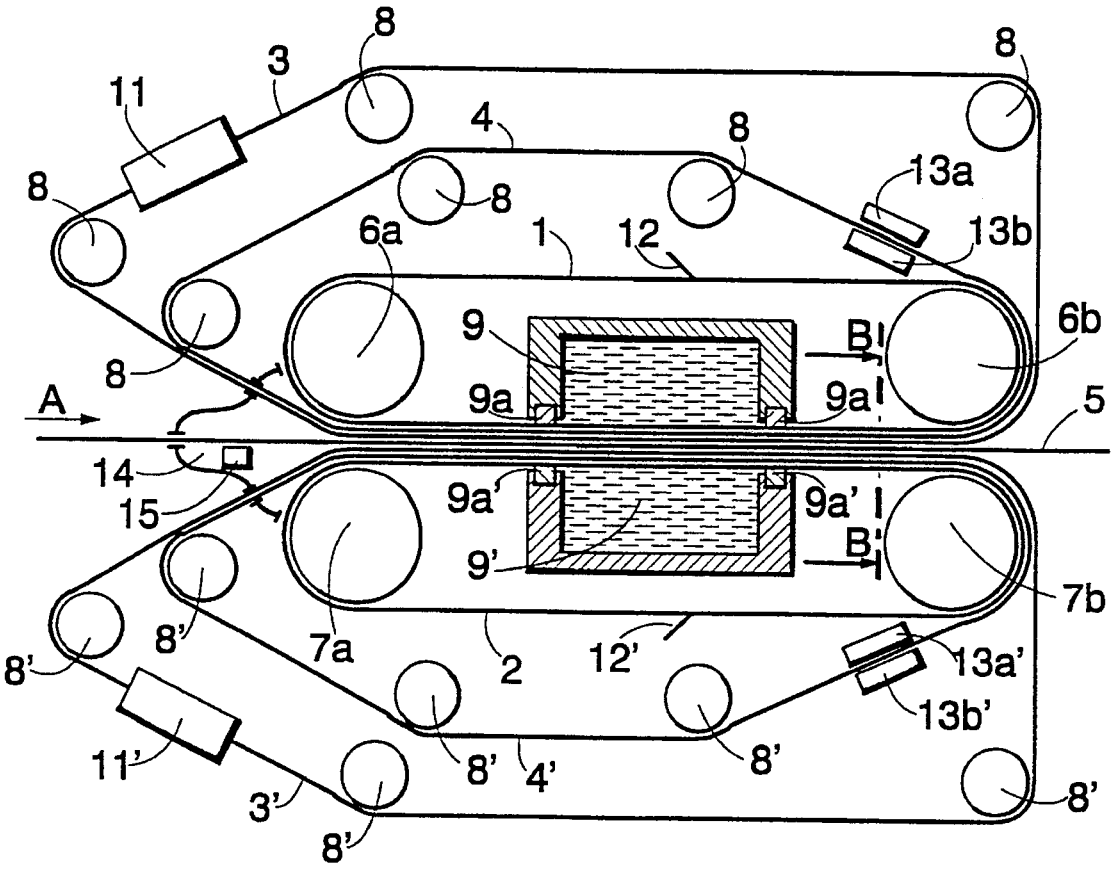

FIG. 1
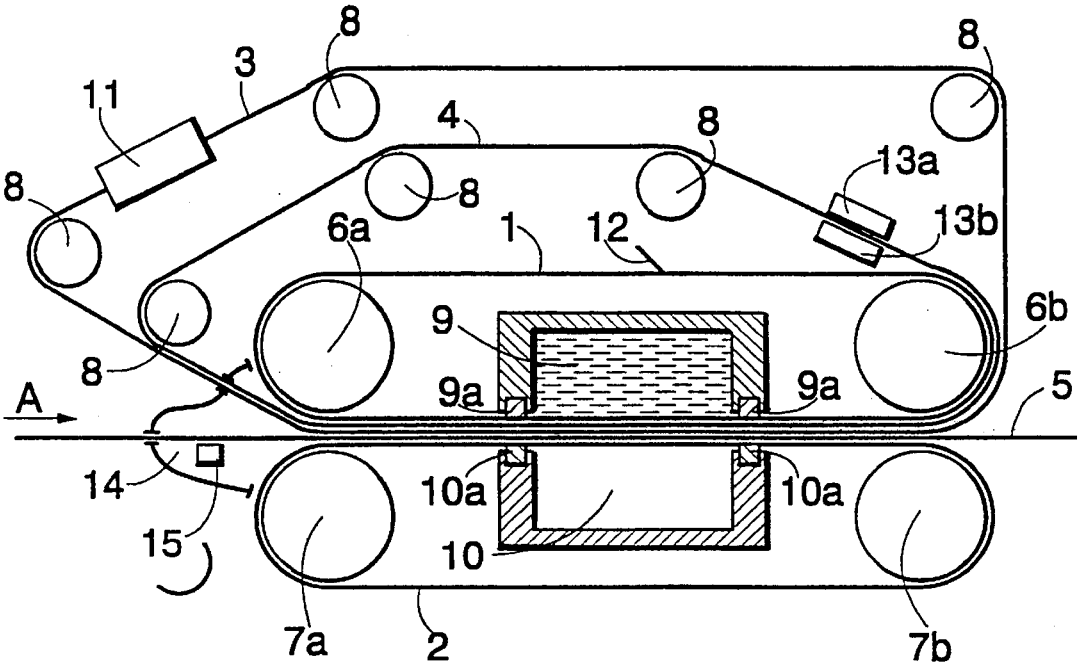
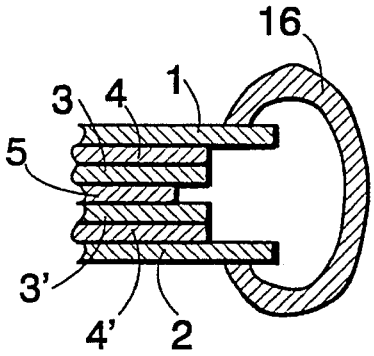
FIG. 3

APPARATUS FOR DRYING A FIBRE WEB, AND A DRYING SECTION OF A PAPER MACHINE

The invention relates to an apparatus for drying a fibre web, the apparatus comprising two endless bands that are impermeable to air; first turning rolls, around which the first band is arranged to run; and second turning rolls, around which the second band is arranged to run; the first and second bands being arranged to run part of the way in parallel such that they define between them a drying zone where at least the first band is cooled and where a heating element is arranged; the fibre web and at least one auxiliary wire being conducted through the drying zone such that the fibre web is in contact with the heating element and the auxiliary wire is in contact with the cooled band.

The invention also relates to a drying section of a paper machine, especially a fine paper machine, the drying section comprising two endless bands that are impermeable to air; first turning rolls, around which the first band is arranged to run; and second turning rolls, around which the second band is arranged to run; the first and second bands being arranged to run part of the way in parallel such that they define between them a drying zone where at least the first band is cooled; a fibre web and at least one auxiliary wire being conducted through the drying zone such that the auxiliary wire is in contact with the cooled band and the fibre web is heated to evaporate the water therefrom.

Drying of a fibre web between two parallel metal bands moving in the same direction such that the fibre web is in contact with a heated metal band and that there is a felt between the fibre web and a second, cooled metal band, whereby the steam removed from the fibre web by heating condenses onto the felt by the effect of the cold metal band, is previously known from many patent publications, such as Finnish Patent 78,755. The operation is based on the idea that two endless metal bands are arranged to run around the turning rolls, and that against the surface that remains inside the resultant loops there are pressure chambers containing hot steam and water, respectively, such that the pressure produced presses the hot and cold bands against the fibre web and felt located between them. Together with seals, the bands located between the pressure chambers provide one side for the pressure chambers such that the steam and water can directly affect the bands. The operation of the apparatus has been disclosed e.g. in the above patent publication, which is incorporated herein by reference.

Further, Finnish Patent 78,755 discloses an apparatus for drying a fibre web. In the apparatus, air is first removed from the web and the drying felt, which are then conducted between two parallel metal bands that move at the same rate as the web and the felt. To effect the drying process, the band that is on the side of the web is heated with a heating apparatus before the band enters the drying zone, and the band that is on the side of the drying felt is cooled before the band enters the drying zone and comes into contact with the drying felt.

The drawback of the above apparatuses for drying a fibre web is the fatigue of the metal belts used as the hot and the cold band under cyclic load, which is also partly due to detrimental chemicals, e.g. thiosulphides or chlorides, that may be present in the web and that reduce the fatigue resistance of stainless steel. Further, since the drying conditions are not exactly the same on both sides of the web, the two sides of the paper are not completely identical, either.

The object of the present invention is to provide a drying apparatus in which the above drawbacks are eliminated and which speeds the drying process.

The drying apparatus of the invention is characterized in that the auxiliary wire is arranged between the heating element and the first, cooled band, and that the heating element is an endless band that is permeable to steam and passes through the drying zone together with the fibre web and the auxiliary wire, whereby steam evaporating from the fibre web passes through the heating element and further through the auxiliary wire toward the first, cooled band, and condenses onto the surface of the first, cooled band.

The drying section of the paper machine according to the invention is also characterized in that both the bands that are impermeable to steam are cooled; that there are two auxiliary wires between them, both of which are in contact with one cooled band; and that between the auxiliary wires there are two bands, e.g. metal wires, that are permeable to steam, form an endless loop, have good thermal conductivity and pass through the drying zone, said bands being heated before the drying zone, and the fibre web that is in contact with said bands being taken between them through the drying zone, whereby the bands heat the water present in the fibre web, turning it into steam, and steam evaporating from the fibre web passes through said steam-permeable bands and further through the auxiliary wires toward the cooled bands and condenses onto the surface of the bands that is on the side of the auxiliary wires.

The essential idea of the invention is that the heating element heating a wet web is an endless band, such as a metal wire, that is permeable to steam, whereby the steam evaporating from the fibre web evaporates through the heating element and further through the auxiliary wire located on the other side of the heating element; and that steam then condenses onto that surface of the cooled band that is on the side of the auxiliary wire. Further, the essential idea of one embodiment is that one side of the fibre web is heated with the above steam-permeable heating element and the other side with another heating element. The essential idea of another embodiment is that both sides of the fibre web are heated with a similar steam-permeable heating element.

One advantage of the invention is that the heating element used can be a mechanically and chemically strong band, such a metal wire. Another advantage of the invention is that identical drying conditions are provided on both sides of the fibre web, whereby the two sides of the paper produced will be identical after the drying process. Yet another advantage is that the invention speeds the drying process.

In the following, the invention will be described in greater detail with reference to the attached drawings, in which FIG. 1 shows a schematic sectional side view of one embodiment of the drying apparatus according to the invention in the travel direction of the web, FIG. 2 shows a schematic sectional side view of another embodiment of the drying apparatus according to the invention in the travel direction of the web, implemented as a drying section of a paper machine, and FIG. 3 shows a cross-sectional view of one detail of the apparatus according to FIG. 2, the cross-section being taken along line B—B of FIG. 2.

FIG. 1 shows a schematic sectional side view of one drying apparatus according to the invention in the travel direction of the web. The drying apparatus comprises a first band 1, or an upper band, and a second band 2, or a lower band, that are endless, are impermeable to air, have good thermal conductivity, and are made e.g. of metal or polymer material. The bands run part of the way in parallel, and a heating wire 3, an auxiliary wire or felt 4, and a fibre web 5 are arranged between those surfaces of the bands that face each other. The fibre web 5 runs between the lower band 2 and the heating wire 3. The upper surface of the heating wire 3 is here against the auxiliary wire 4, and the auxiliary wire, in turn, is against the upper band 1. The fibre web moves to the direction indicated by arrow A. The first band 1 is arranged to turn around first turning rolls 6*a* and 6*b* located at the ends of the drying apparatus. The second band 2, in turn, is arranged to turn around second turning rolls 7*a* and 7*b* which are located below turning rolls 6*a* and 6*b* at the ends of the drying apparatus. Wires 3 and 4 are supported and guided with guide rolls 8. For the sake of clarity, the support of wires 3 and 4 with the guide rolls 8 is presented in FIG. 1 in a simplified form. The support and guidance of wires 3 and 4 are, as such, known from the prior art, and so they will not be discussed in greater detail herein. Since the pressure prevailing in the drying zone, in the space between bands 1 and 2, is usually different from the pressure prevailing outside or on the sides of bands 1 and 2, seals are arranged between bands 1 and 2, or close to their edges, on both sides of the apparatus, the seals preventing transfer of liquid or gas laterally from the space between bands 1 and 2, or vice versa. One example for a seal like this is shown in greater detail in FIG. 3. Supporting members can be arranged in the drying zone to support the bands 1 and 2, the wires 3 and 4 and the fibre web 5 from below in a manner known per se. To generate the heat needed for the drying, a heating unit 11 is arranged to heat the heating wire 3. The heating wire 3 thus functions as the heating element of the drying apparatus. A cooling chamber 9 is arranged to cool the first band 1, the edges of the chamber comprising seals 9*a* with which the first band 1 is sealed relative to the cooling chamber 9. At the first band 1 is arranged a doctor blade 12, with which moisture condensed onto the first band 1 is removed from the surface of the band. At the auxiliary wire 4 is arranged a blow box 13*a* and a suction box 13*b*, which are used for removing moisture from the auxiliary wire 4. The auxiliary wire 4 may be either a plastic wire or a felt, the essential feature being that the auxiliary wire 4 can hold the condenser water formed by the moisture removed from the web.

The basis for the operation of the drying apparatus is that the heating wire 3, which is in contact with the web 5, is heated in the heating unit 11, whereby the heat of the heating wire 3 heats the water present in the web 5 so that it evaporates and passes through the heating wire 3 and the auxiliary wire 4 toward the first band 1. The first band 1, in turn, is continuously cooled by the cooling chamber 9 located above it, whereby the steam on its surface condenses into water and discharges with the auxiliary wire 4. The cooling chamber 9 may be essentially free of pressure or it may be pressurized, whereby the fibre web 5 can be subjected to the desired pressure in the direction of thickness by regulating the pressure in the cooling chamber 9. The pressure can also be controlled by regulating the temperature of the cooled band.

The drying process can be made increasingly effective by arranging a heating chamber 10 below the second band 2. The second band 2 is sealed relative to the heating chamber 10 with seals 10*a*. The second band 2 is then heated with a medium present in the heating chamber 10.

Before the fibre web 5, heating wire 3 and auxiliary wire 4 are conducted between the bands, they are conducted through an air exhaust unit 14, in which air is exhausted from the pores of the web 5 and the wires 3 and 4 as carefully as possible, e.g. by passing through them saturated steam of a suitable temperature, the steam pushing the air molecules away from the pores, replacing them with water molecules contained in the steam. Further, inside the air exhaust unit 14 can be arranged a so-called coanda box 15, which supports the fibre web 5 by means of the steam fed through said coanda box 15. One or more coanda boxes 15 can be arranged one after the other in the travel direction of the web 5. Since the air exhaust unit 14 and the coanda box 15 are, as such, known from the prior art, they will not be discussed in greater detail herein.

The heating wire 3 can be heated in the heating unit 11 e.g. by allowing the back-pressure steam to condense directly onto the surfaces of the heating wire 3 in some kind of a pressurized steam chamber through which the heating wire 3 passes via suitable apertures provided with seals, and by removing the produced condensate from the surfaces of the heating wire 3 e.g. with superheated steam in the final step of the heating unit 11. Further, the heating wire 3 can be heated with hot gas using gas jets or burners. It is also possible to use IR radiators or induction heating, or some other heating method known per se.

To remove water from the auxiliary wire 4 after the drying step, it is possible to use both a blow box 13*a* and a suction box 13*b*, which are located on the opposite sides of the wire 4, or only one of them.

FIG. 2 shows a schematic sectional side view of another embodiment of the apparatus according to the invention in the travel direction of the web. It shows a drying section of a paper machine that is especially well-suited for the drying of fine printing papers, etc. The numbers used in FIG. 2 correspond to those of FIG. 1. In the apparatus of FIG. 2, structures corresponding to those arranged above the fibre web 5 in FIG. 1 are arranged on both sides of the fibre web 5. In FIG. 2, the structures below the fibre web 5, which correspond to the structures above the fibre web 5 in FIG. 1, are indicated by corresponding numbers as in FIG. 1, except that in FIG. 2 the numbers are followed by an apostrophe (e.g. 3', 4'). The first band 1, for example, is thus cooled by cooling chamber 9, and the second band 2 is cooled by a corresponding cooling chamber 9'. The drying conditions on both sides of the fibre web 5 are then similar, i.e. moisture evaporates from the fibre web 5 both toward the first band 1 and toward the second band 2. On account of this, the fibre web 5 dries on both sides equally well, and so the two sides of the dried paper are identical after the drying. Further, the apparatus concerned speeds the drying process.

FIG. 3 shows a cross-sectional view of the edge of the drying zone, the cross-section being taken along line B—B of FIG. 2. The reference numbers of FIG. 3 correspond to those of FIGS. 1 and 2. The first band 1 and the second band 2 can be sealed with a seal 16, which bears against the upper surface of the first band 1 and the lower surface of the second band 2 in the manner shown in FIG. 3. The seal 16 need not necessarily be in contact with bands 1 and 2. The steam inside the seal 16 can thereby exude from between the seal 16 and the bands 1 and 2. Further, other seals may be arranged between the first band 1 and the second band 2 in a manner known per se.

The drying apparatus according to the invention is particularly advantageous in the production of thin printing paper, but it can also be applied to the production of other kinds of paper. When e.g. 45-gram-newsprint is dried with the present drying apparatuses so that the dry matter content of the paper increases from 50% to 93% while the temperature in the heating element is 190° C., the maximum running rate used is 25 m/sec, the typical running rate being 20 m/sec. The required length of a drying section is then over 50 m. The apparatus according to the present invention makes it possible to increase the running rate to 40 m/sec, or, at a running rate of 25 m/sec, to shorten the drying section to 25 m. It is thus possible either to speed the process or to make the drying apparatus smaller, whereby the drying apparatus is cheaper to construct and requires less space.

The description and the drawings attached thereto are intended only to illustrate the idea of the invention. The drying apparatus according to the invention may vary in its details within the scope of the claims. It is thus not essential what medium is used in the heating and cooling chambers. For example, the medium in the cooling chamber 9 may be e.g. water or air, or some other suitable medium. Further, the medium in the heating chamber 10 may be e.g. steam, air or hot fuel combustion products.

The first 1 and second band 2 can also be cooled in some other Way than by a cooling chamber. They can e.g. be cooled outside the drying zone. A separate pressure chamber that contains e.g. air can then be arranged to press the fibre web 5 in the direction of thickness. Also, the optional heating of the second band 2 can be carried out in some other way than by a heating chamber 10.

I claim:

1. An apparatus for drying a fibre web, the apparatus comprising a) first and second endless bands that are impermeable to air;

b) first turning rolls, around which the first band turns;

c) second turning rolls, around which the second band turns; the first and second bands having respective paths that are in part parallel such that they define between them a drying zone where at least the first band is cooled;

d) a heating element comprising an endless band that is permeable to steam; and c) at least one auxiliary wire; the fibre web and the at least one auxiliary wire being disposed in the drying zone with the fibre web in contact with the heating element and the auxiliary wire in contact with the first band, and with the auxiliary wire disposed between the heating element and the first band, the first and second turning rolls being disposed so that the heating element passes through the drying zone together with the fibre web and the auxiliary wire, whereby steam evaporating from the fibre web passes through the heating element and further through the auxiliary wire toward the first band, and condenses onto a surface of the first band.

2. A drying apparatus according to claim 1, wherein the second band is also heated and the fibre web is in contact with the second band.

3. A drying apparatus according to claim 1, wherein both the first and second bands are cooled, the apparatus further comprising a second heating element comprising an endless band that is permeable to steam disposed on an opposite side of the fibre web, and a second auxiliary wire disposed between the second heating element and the second band, whereby steam evaporating from the fibre web passes through both the first and second heating elements and further through both the first and second auxiliary wires toward both the first band and the second band, and whereby steam condenses onto a surface of both the first band and the second band.

4. A drying apparatus according to claim 1, wherein the steam-permeable heating element is a heating wire that is heated in a heating unit before said heating wire enters the drying zone.

5. A drying apparatus according to claim 4, wherein the heating wire is a metal wire.

6. A drying section of a paper machine, comprising first and second endless bands that are impermeable to air; first turning rolls, around which the first band turns; and second turning rolls, around which the second band turns; the first and second bands having respective paths that are in part parallel such that they define between them a drying zone where at least the first band is cooled; a fibre web and at least a first auxiliary wire being disposed in the drying zone such that the first auxiliary wire is in contact with the first band and the fibre web is heated to evaporate water therefrom, both the first and second bands being cooled; the drying section also comprising a second auxiliary wire, the first and second auxiliary wires being disposed between the first and second bands with each of the first and second bands in contact with a respective one of the first and second auxiliary wires; the drying section being provided with two steam-permeable bands between the first and second auxiliary wires that are permeable to steam, form an endless loop, have good thermal conductivity and pass through the drying zone, said steam-permeable bands being heated, the fibre web being in contact with said steam-permeable bands and being disposed between them in the drying zone, whereby the steam-permeable bands heat the water present in the fibre web, turning it into steam, and steam evaporating from the fibre web passes through said steam-permeable bands and further through the first and second auxiliary wires toward the first and second bands and condenses onto a surface of the first and second bands.

* * * * *